US008047017B2

(12) United States Patent
Lim et al.

(10) Patent No.: US 8,047,017 B2
(45) Date of Patent: Nov. 1, 2011

(54) REFRIGERATOR AND EVAPORATOR MOUNTING STRUCTURE THEREFOR

(75) Inventors: Jae Hoon Lim, Suwon-si (KR); Wan Hyeong Lee, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 649 days.

(21) Appl. No.: 12/071,773

(22) Filed: Feb. 26, 2008

(65) Prior Publication Data

US 2008/0202141 A1 Aug. 28, 2008

(30) Foreign Application Priority Data

Feb. 26, 2007 (KR) ..... 10-2007-0019193

(51) Int. Cl.
*F25D 11/00* (2006.01)

(52) U.S. Cl. ..... 62/440

(58) Field of Classification Search ..... 62/259.1, 62/259.4, 465, 515–517, 440, 407, 411, 418, 62/441, 466; 312/36, 116; 403/13; 165/67
See application file for complete search history.

(56) References Cited

U.S. PATENT DOCUMENTS

| | | | | | |
|---|---|---|---|---|---|
| 1,356,575 | A | * | 10/1920 | Weiss | 40/746 |
| 3,169,292 | A | * | 2/1965 | Fenton | 24/619 |
| 3,683,636 | A | * | 8/1972 | Tobey | 62/276 |
| 4,674,910 | A | * | 6/1987 | Hayashi | 403/408.1 |
| 4,995,245 | A | * | 2/1991 | Chang | 62/515 |
| 5,263,535 | A | * | 11/1993 | Philo et al. | 165/67 |
| 5,727,859 | A | * | 3/1998 | Jeong et al. | 312/404 |
| 5,819,552 | A | * | 10/1998 | Lee | 62/407 |
| 6,158,500 | A | * | 12/2000 | Heine | 165/67 |
| 6,230,511 | B1 | * | 5/2001 | Lee et al. | 62/277 |
| 6,279,334 | B1 | * | 8/2001 | Ishikawa et al. | 62/239 |
| 2004/0144128 | A1 | * | 7/2004 | Junge et al. | 62/441 |
| 2005/0008428 | A1 | * | 1/2005 | Desai et al. | 403/13 |

FOREIGN PATENT DOCUMENTS

KR 1999-0028752 7/1999

* cited by examiner

*Primary Examiner* — Frantz Jules
*Assistant Examiner* — Emmanuel Duke
(74) *Attorney, Agent, or Firm* — Staas & Halsey LLP

(57) ABSTRACT

A refrigerator having a mounting structure to firmly fix an evaporator to the refrigerator. In the refrigerator including an evaporator and a cover to be coupled with the evaporator, the evaporator includes first fixing portions to be coupled with the cover and the cover includes second fixing portions to correspond to the first fixing portions. The evaporator and the cover are coupled with each other by the first and second fixing portions without separate fasteners.

3 Claims, 6 Drawing Sheets

REFRIGERATOR AND EVAPORATOR MOUNTING STRUCTURE THEREFOR

CROSS-REFERENCE TO RELATED APPLICATIONS

This application claims the benefit of Korean Patent Application No. 2007-0019193, filed on Feb. 26, 2007 in the Korean Intellectual Property Office, the disclosure of which is incorporated herein by reference.

BACKGROUND

1. Field

The present invention relates to a refrigerator, and, more particularly, to a refrigerator having an evaporator mounting structure capable of improving the operation efficiency of the refrigerator.

2. Description of the Related Art

In general, a refrigerator includes a freezing compartment and a refrigerating compartment for keeping food, etc., cool by cold air that is introduced into the compartments after being heat exchanged by an evaporator. A machine room having a compressor and a condenser therein is provided in a lower position of a rear surface of the freezing or refrigerating compartment.

The refrigerating compartment, included in the above described general refrigerator, keeps food, etc., fresh at a temperature of approximately 3° C.~5° C., and the freezing compartment freezes food, etc., and keeps the food frozen for a long term at a sub-zero temperature.

The refrigerator includes an evaporator to lower the temperature of the interior air of the freezing compartment and the refrigerating compartment. A drain device is located on the underside of the evaporator and arranged along an inner wall of a refrigerator body.

When fins, pipes, etc. of the evaporator are covered with frost during circulation of a refrigerant, a defrosting heater, mounted adjacent to the evaporator, is operated for a predetermined time to remove the frost. Water caused by defrosting is collected in a drain sump, and discharged to the outside through a drain hole.

In the related art, to fix the evaporator to the refrigerator, holders are provided at both lateral surfaces of the evaporator. The holders have upper ends formed with screw holes to fix the evaporator to the refrigerator body using fasteners such as screws, etc, and lower ends supported by the drain sump.

The above described evaporator mounting structure, however, has problems of a complicated fastening operation and long fastening time due to the use of the fasteners such as the screws, etc.

To solve the above described problems, Korean Utility Model Laid-open Publication No. 1999-0028752 discloses an evaporator mounting structure to seat an evaporator in a refrigerator body, and more particularly, in a drain sump without fasteners.

In the evaporator mounting structure for a refrigerator disclosed in the above Publication, each evaporator holder is formed at an upper end thereof with an inserting piece to be inserted into a refrigerator body, and at an outwardly-bent portion of a lower end thereof with an inserting hole. In a state wherein the inserting piece is inserted into a recess formed in the refrigerator body, the evaporator is moved downward until the inserting hole is caught by a corresponding supporting rib formed in a drain sump, so as to seat the evaporator in the drain sump.

Although the above described evaporator mounting structure does not use fasteners, it has a need for relatively complex mounts at the upper and lower ends of the evaporator holder for the mounting of the evaporator.

Further, the evaporator mounting structure has limited strength with respect to mounting of the evaporator, and may result in unwanted displacement of the evaporator.

SUMMARY

Accordingly, it is an aspect of the present invention to provide a refrigerator having a mounting structure to firmly fix an evaporator to the refrigerator with an improved assembling efficiency and reduced assembling time.

Additional aspects and/or advantages will be set forth in part in the description which follows and, in part, will be apparent from the description, or may be learned by practice of the invention.

The foregoing and/or other aspects of the present invention are achieved by the provision of a refrigerator comprising an evaporator and a cover to be coupled with the evaporator, wherein the evaporator comprises a plurality of first fixing portions to be coupled with the cover and the cover comprises a plurality of second fixing portions to respectively correspond to the first fixing portions such that the evaporator and the cover are coupled with each other by the first and second fixing portions without separate fasteners.

The first fixing portions may be flexible protruding portions protruding from both lateral sides of the evaporator, and the second fixing portions may be insertion holes to receive the protruding portions.

The first fixing portions may be through-holes, and the second fixing portions may be elastic protuberances to be inserted into the through-holes, respectively, so as not to be separated from the through-holes.

The cover may further include a sump to receive water generated during defrosting.

The foregoing and/or aspects of the present invention are also achieved by providing a refrigerator comprising an evaporator and a cover to be coupled with the evaporator, wherein the evaporator comprises a plurality of fixing members having flexible protruding portions, and the cover comprises a plurality of insertion holes to respectively correspond to the protrusions, respectively.

The protruding portions may be bent toward a surface of the cover after being penetrated into the insertion holes, to fix the evaporator.

The cover may further include a sump to receive water generated during defrosting.

The fixing members may be provided at both lateral sides of the evaporator.

The protruding portions may be provided in the same plane as the fixing members and have a predetermined thickness suitable to be bent.

The foregoing above and/or other aspects can be achieved by providing of an evaporator mounting structure for a refrigerator comprising: an evaporator having a plurality of fixing members formed with protruding portions; and a cover having a plurality of insertion holes to correspond to the protruding portions, respectively, wherein the protruding portions are bent toward a surface of the cover after being penetrated through the insertion holes, to couple the evaporator and the cover with each other.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
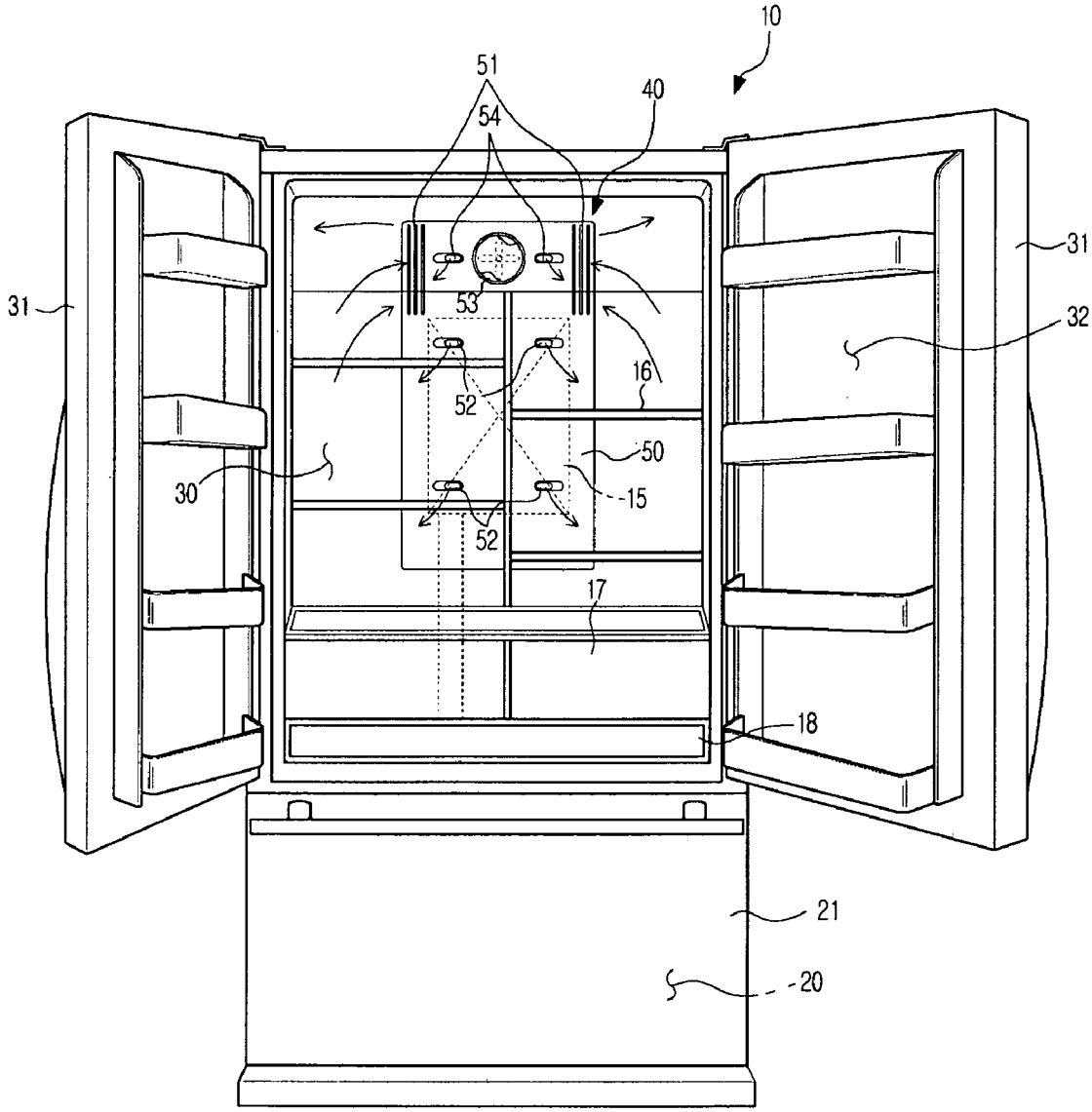
FIG. 1 is a perspective view showing the outside of a refrigerator according to the first embodiment of the present invention, in a state wherein refrigerating compartment doors are opened.

Reference will now be made in detail to the embodiments, examples of which are illustrated in the accompanying drawings, wherein like reference numerals refer to the like elements throughout. The embodiments are described below to explain the present invention by referring to the figures.

An embodiment of the present invention relates to a so-called "French" type refrigerator, in which a refrigerating compartment and a freezing compartment are arranged up and down and the refrigerating compartment has a pair of doors installed at a front surface thereof.

Figure 2:
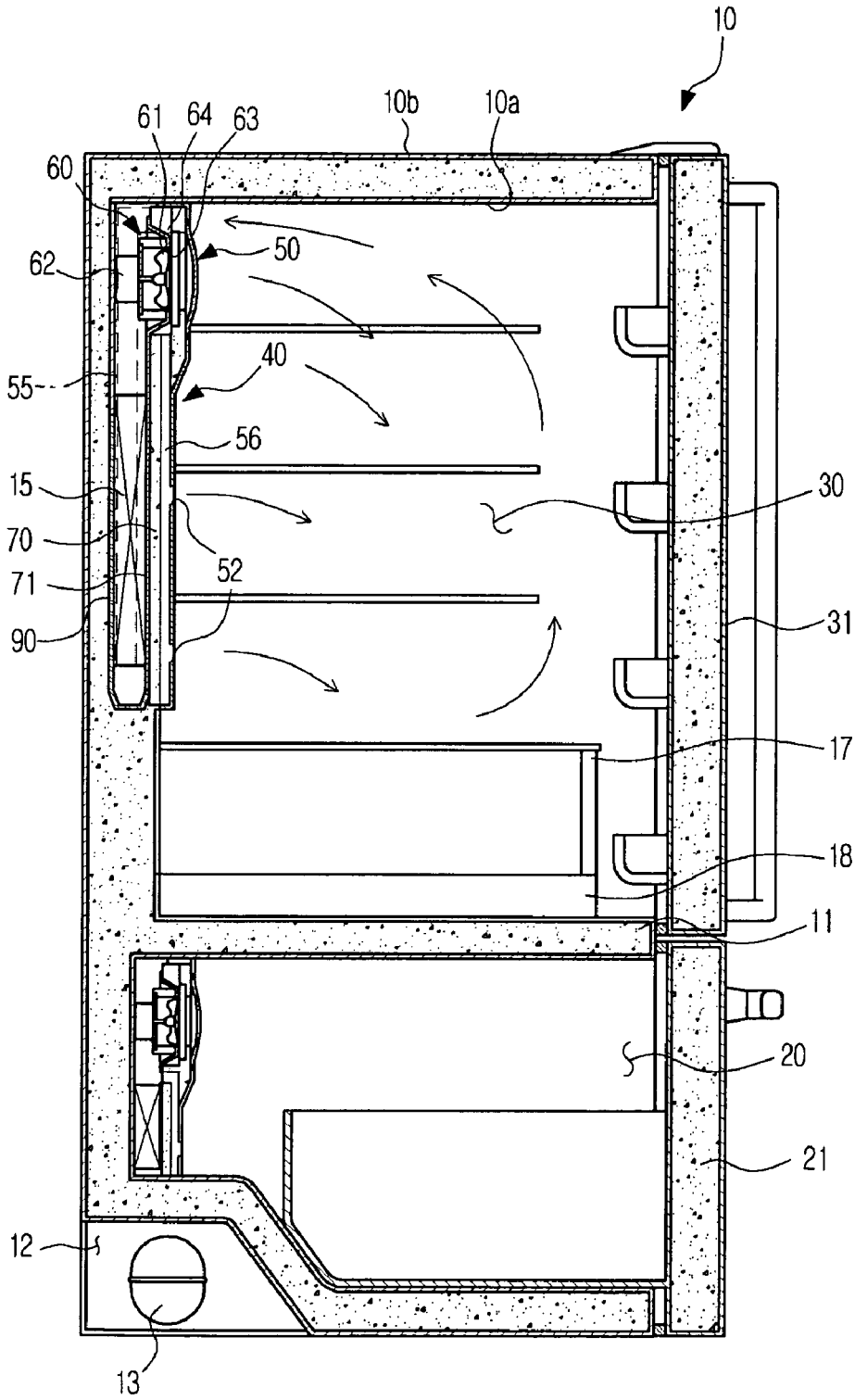
FIG. 2 is a side sectional view of the refrigerator according to the first embodiment of the present invention.

FIG. 1 is a perspective view showing the opened state of the refrigerating compartment doors included in the refrigerator according to the first embodiment present invention. FIG. 2 is a side sectional view of the refrigerator of FIG. 1.

The refrigerator according to the embodiment of the present invention, as shown in FIGS. 1 and 2, includes a body 10 having a plurality of storage compartments 20 and 30 divided up and down by a horizontal insulating partition 11, and doors 21 and 31 provided at front surfaces of the storage compartments 20 and 30 to open or close the storage compartments 20 and 30.

It will be appreciated that the refrigerator according to the embodiment of the present invention includes refrigeration cycle elements, for example, a compressor 13, condenser (not shown), expansion unit (not shown), and an evaporator 15.

The body 10 has a machine room 12 defined in a lower rear region thereof. The machine room 12 receives electric elements such as the compressor 12, etc. An insulating foam material is filled between an inner shell 10*a* and an outer shell 10*b* of the body 10.

The storage compartments 20 and 30 are located above the machine room 12. The storage compartment 30 located above the insulating partition 11 serves as a refrigerating compartment, and the storage compartment 20 located below the insulating partition 11 serves as a freezing compartment.

The freezing compartment 20 has a sliding type freezing compartment door 21 installed at a front surface thereof. The refrigerating compartment 30 has a pair of refrigerating compartment doors 31 installed at a front surface thereof, the doors 31 being hingedly coupled to opposite side edges of the body 10 to be pivotally rotated. Each refrigerating compartment door 31 has receiving spaces 32 defined in an inner surface thereof.

The refrigerating compartment 30 defined in the upper region of the body 10 includes the evaporator 15 mounted to a rear surface of the refrigerating compartment 30 to produce cold air to be supplied into the refrigerating compartment 30, shelves 16 and receiving drawers 17 to receive food, etc., which are kept cool, and a cold air supply device 40 to supply the cold air, which was heat exchanged by the evaporator 15, into the refrigerating compartment 30.

The internal configuration of the refrigerating compartment can be also applied to the freezing compartment, and hereinafter, only the refrigerating compartment will be described without the description of the freezing compartment.

The plurality of shelves 16 provided in the refrigerating compartment 30 are adjustable in height, and a pair of the receiving drawers 17 are provided on the underside of the lowermost shelf. In turn, a pantry 18 is provided on the underside of the pair of receiving drawers 17 to store relatively large size groceries.

The cold air supply device 40, disposed in front of the evaporator 15 to supply cold air into the refrigerating compartment 30, includes a cold air duct 50 having flow paths formed therein, a blower 60 to forcibly circulate the cold air, and an insulating member 70 mounted to a rear surface of the cold air supply device 40 to separate the evaporator 15 from the cold air duct 50.

The cold air duct 50 has a rectangular shape, and also has a centrally protruding streamlined cross sectional shape. The cold air duct 50 is perforated in a front surface thereof with suction holes 51 and discharge holes 52, 53, and 54.

The suction holes 51 include a pair of suction holes 51 symmetrically perforated in opposite upper corners of the front surface of the cold air duct 50 to suction cold air in the refrigerating compartment 30.

The discharge holes 52, 53, and 54 to discharge the heat-exchanged cold air into the refrigerating compartment 30 include a plurality of front discharge holes 52 perforated in the front surface of the cold air duct 50 to be vertically spaced apart from one another by a predetermined distance so as to discharge cold air toward the front side of the refrigerating compartment 30, front wave-shaped discharge holes 53 perforated in the upper center of the cold air duct 50 to guide the cold air, blown by the blower 60, to be discharged into the refrigerating compartment 30 rather than guiding the cold air to pass through discharge flow paths 65 that will be described hereinafter, and upper discharge holes 54 perforated at opposite sides of the front wave-shaped discharge holes 53.

The cold air duct 50 further includes flow paths 55 and 56 formed therein. If cold air is introduced into the cold air duct 50 through the suction holes 51, the flow paths 55 and 56 guide the cold air to the evaporator 15 such that the cold air is heat exchanged by the evaporator 15. Thereafter, the heat-exchanged cold air is guided to the front discharge holes 52 through the flow paths 55 and 56.

The flow paths 55 and 56 include suction flow paths 55 each having one side to communicate with the corresponding suction hole 51 and the other side extending downward to communicate with a lower portion of the evaporator 15, and discharge flow paths 56 to guide the heat-exchanged cold air to the front discharge holes 52, each having one side to communicate with an upper portion of the evaporator 15 and the other side to communicate with the corresponding front discharge hole 52.

The blower 60, disposed above the evaporator 15 to forcibly circulate the cold air, includes a blowing fan 61, a drive motor 62 to provide the blowing fan 61 with a drive force, a bell-mouth 63, and a mounting portion 64 to fix the drive motor 62 therein.

With the above described flow paths, if the cold air is suctioned into the cold air duct 50 through the suction holes 51, the cold air is guided to the lower portion of the evaporator 15 through the suction flow paths 55, so as to be heat exchanged by the evaporator 15. The heat-exchanged cold air is partially guided to the upper and front discharge holes 54 and 53 by passing through the bell-mouth 63. The remaining cold air is guided to the front discharge holes 52 through the discharge flow paths 56, thereby being discharged into the refrigerating compartment 30 to lower the temperature of the refrigerating compartment 30.

The insulating member 70 is provided between the evaporator 15 and the discharge flow paths 56, to separate the evaporator 15 from the discharge flow paths 56. The insulating member 70 has a barrier plate 71 fixed thereto to prevent water, generated during defrosting of the evaporator 15, from permeating into the insulating member 70 while guiding the water to a water sump 92 provided below the insulating member 70.

Figure 3:
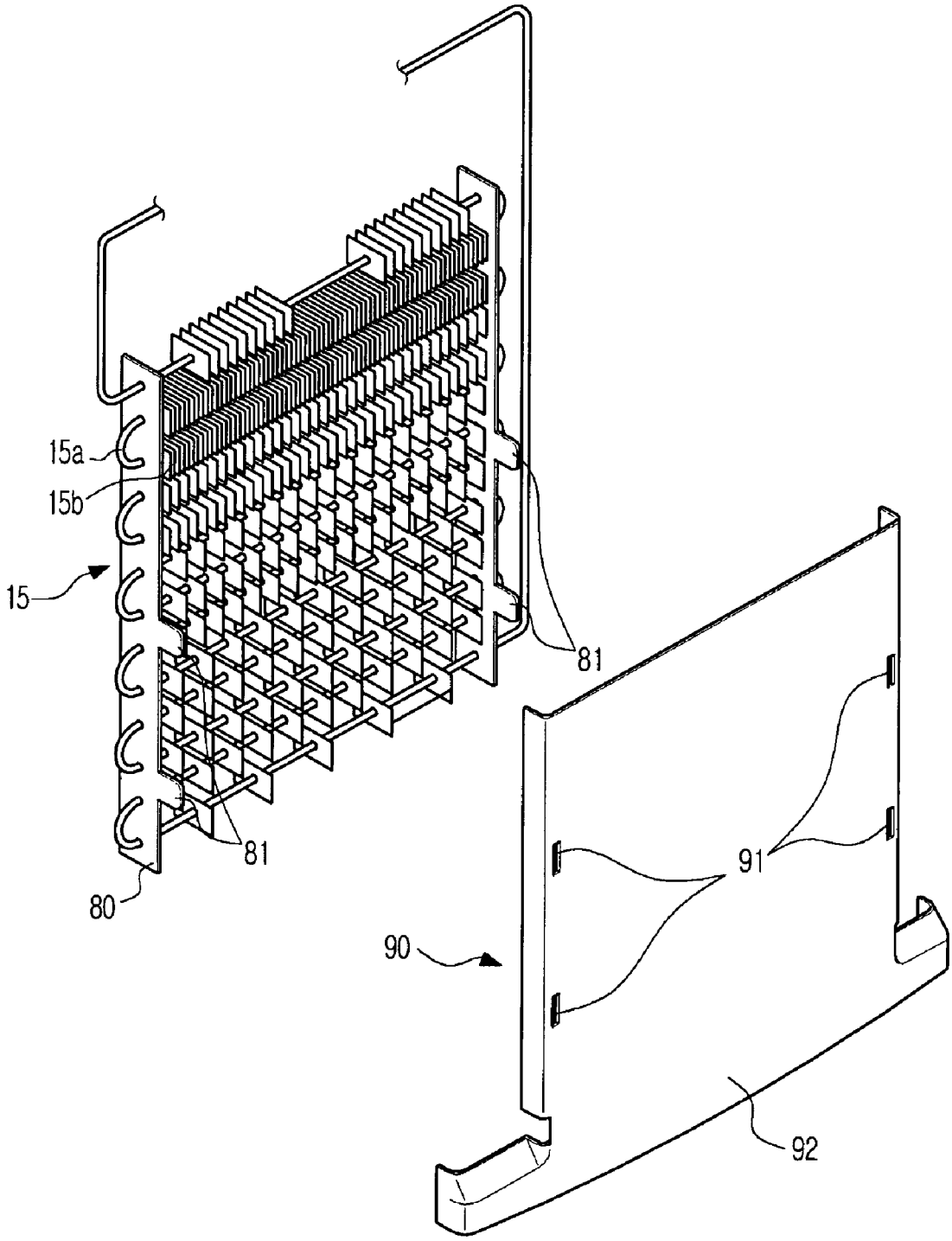
FIG. 3 is an exploded perspective view showing an evaporator and a cover included in the refrigerator according to the first embodiment of the present invention.
Figure 4:
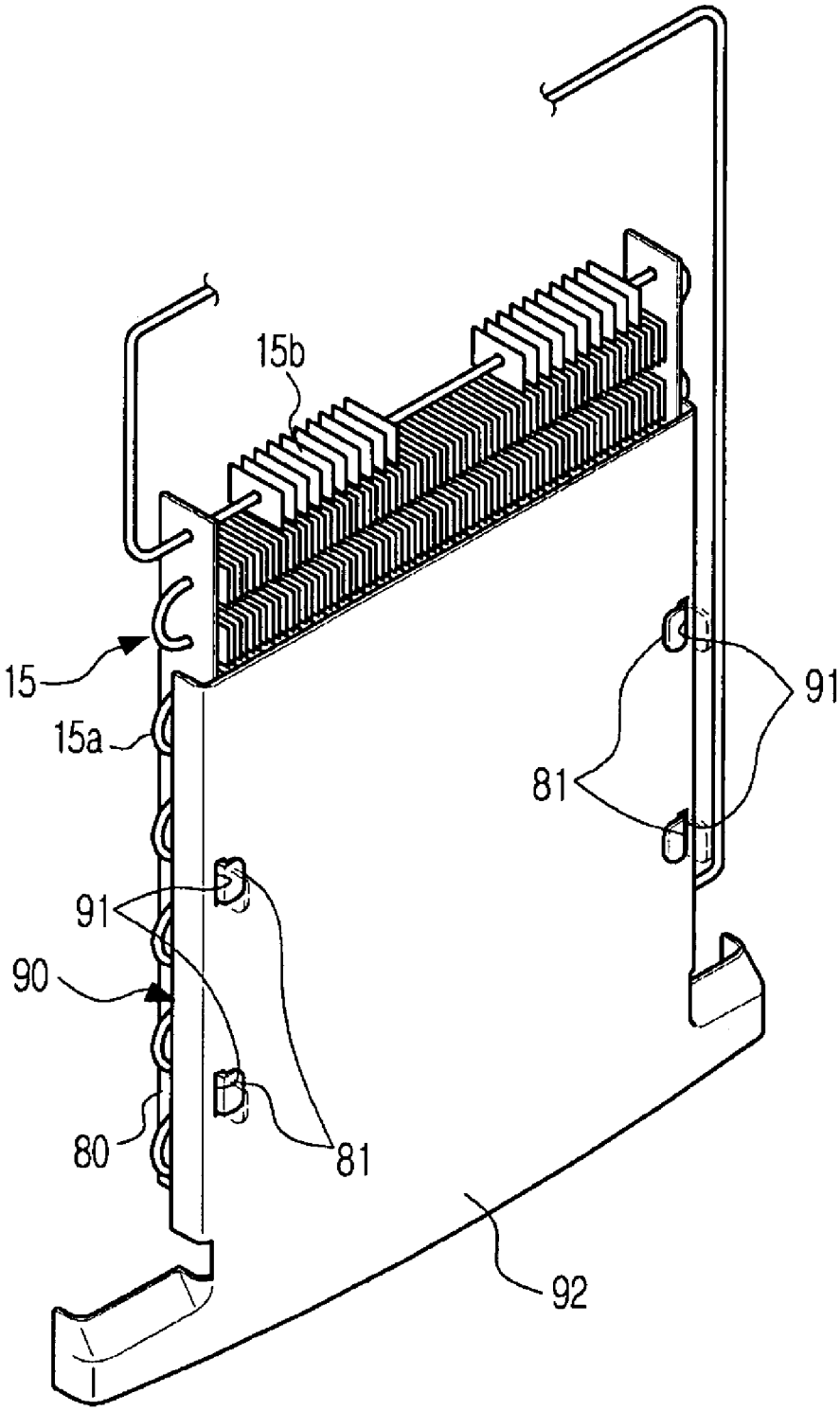
FIG. 4 is a perspective view showing the assembled state of the evaporator and the cover shown in FIG. 3.

FIG. 3 is an exploded perspective view showing the evaporator and a cover included in the refrigerator according to an embodiment of the present invention, and FIG. 4 is a perspective view showing the assembled state of the evaporator and the cover shown in FIG. 3.

The evaporator 15 includes a refrigerant pipe 15*a* through which a refrigerant flows, electric heating fins 15*b* made of a high-conductivity thin plate, the refrigerant pipe 15*a* being penetrated through the electric heating fins 15*b* to increase a heat exchange area between air and the refrigerant pipe 15*a*, and fixing members 80 provided at both lateral sides of the evaporator 15 to couple the evaporator 15 with a cover 90 that will be described hereinafter.

The fixing members 80 are made of a thin metal material, and are fixed to both lateral positions of the refrigerant pipe 15*a*. Each fixing member 80 has a first fixing portion to be coupled with the cover 90. The first fixing portion is a protruding portion 81 protruding from the fixing member 80 toward the cover 90 by a predetermined length to be placed in the same plane as the fixing member 80. The protruding portion 81 takes the form of a flexible plate having a predetermined thickness. Each fixing member 80 is formed with a plurality of protruding portions 81.

The refrigerator according to the embodiment of the present invention is provided with the cover 90 at the rear side of the evaporator 15 to mount the evaporator 15 to the rear surface of the refrigerating compartment.

The cover 90 has a predetermined width suitable to seat the evaporator 15 thereon, and both ends of the cover 90 are bent toward the evaporator 15 to receive the evaporator 15 therein.

The cover 90 has second fixing portions formed at positions thereof corresponding to the plurality of protruding portions 81, to be coupled with the evaporator 15 to fix the evaporator 15. The second fixing portions are insertion holes 91 to receive the protruding portions 81. As shown in FIG. 4, to couple the evaporator 15 with the cover 90, if the protruding portions 81 of the evaporator 15 are inserted into the insertion holes 91 formed in the cover 90 from one surface of the cover 90, the protruding portions 81 penetrate through the insertion holes 91 to protrude from the other surface of the cover 90. Then, the protruding portions 81 are bent toward the center of the cover 90 by an angle of approximately 90 degrees, to complete the coupling of the evaporator 15 and the cover 90.

The cover 90, to which the evaporator 15 was mounted as described above, is mounted to the inner rear surface of the refrigerating compartment 30, and thereafter, a foam material is injected into a gap between the inner shell 10*a* and the outer shell 10*b*.

The above described evaporator mounting structure for the refrigerator has no need for fasteners, and can achieve firm fixation of the evaporator in a relatively simplified manner.

The water sump 92 is provided below the cover 90, to discharge water generated upon defrosting to the outside. Although the cover and the water sump may be integrally formed with each other, it will be appreciated that they may be separately prefabricated and then assembled with each other by separate elements.

Now, an evaporator mounting structure according to the second embodiment of the present invention will be described.

Figure 5:
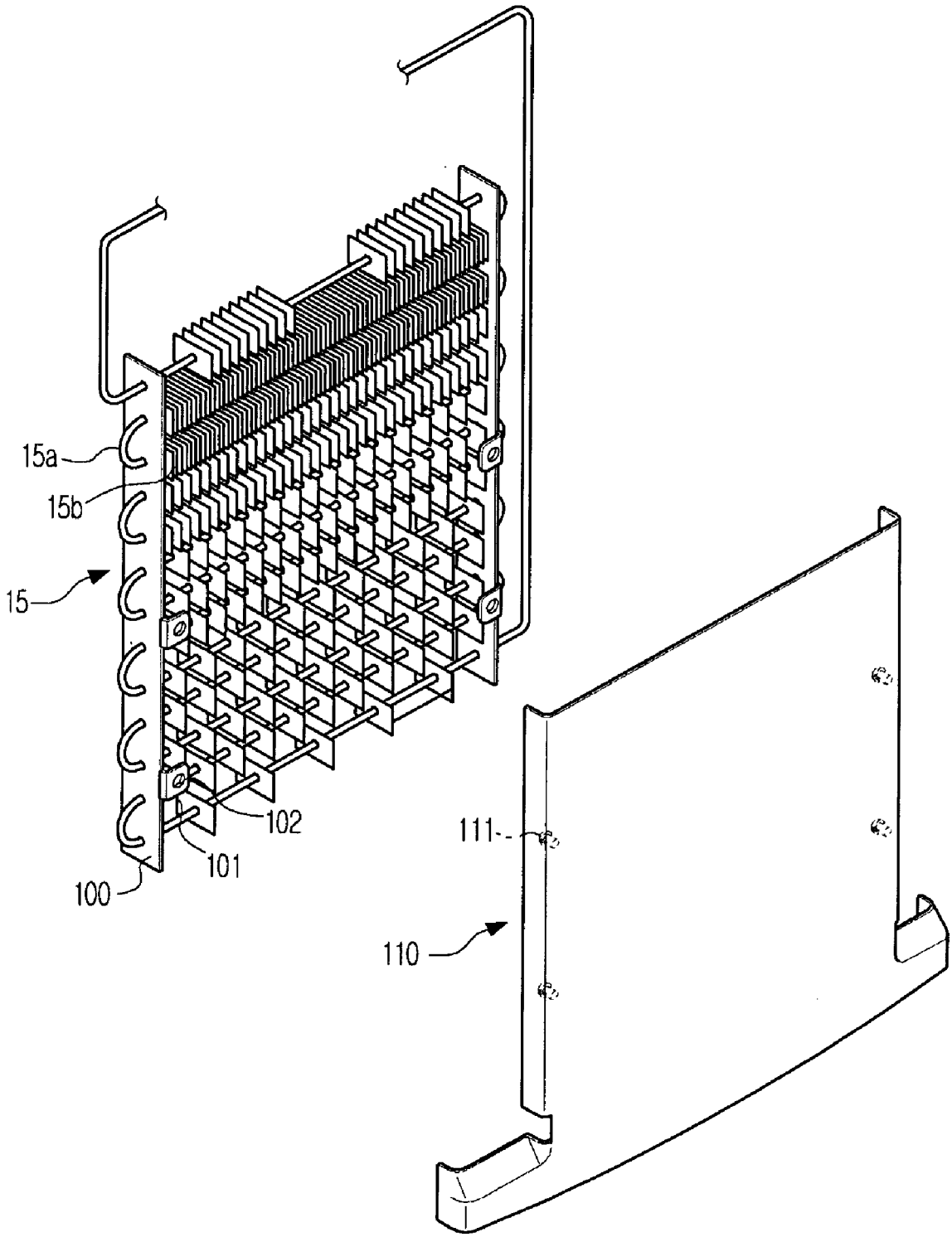
FIG. 5 is an exploded perspective view of an evaporator and a cover according to a second embodiment of the present invention.
Figure 6:
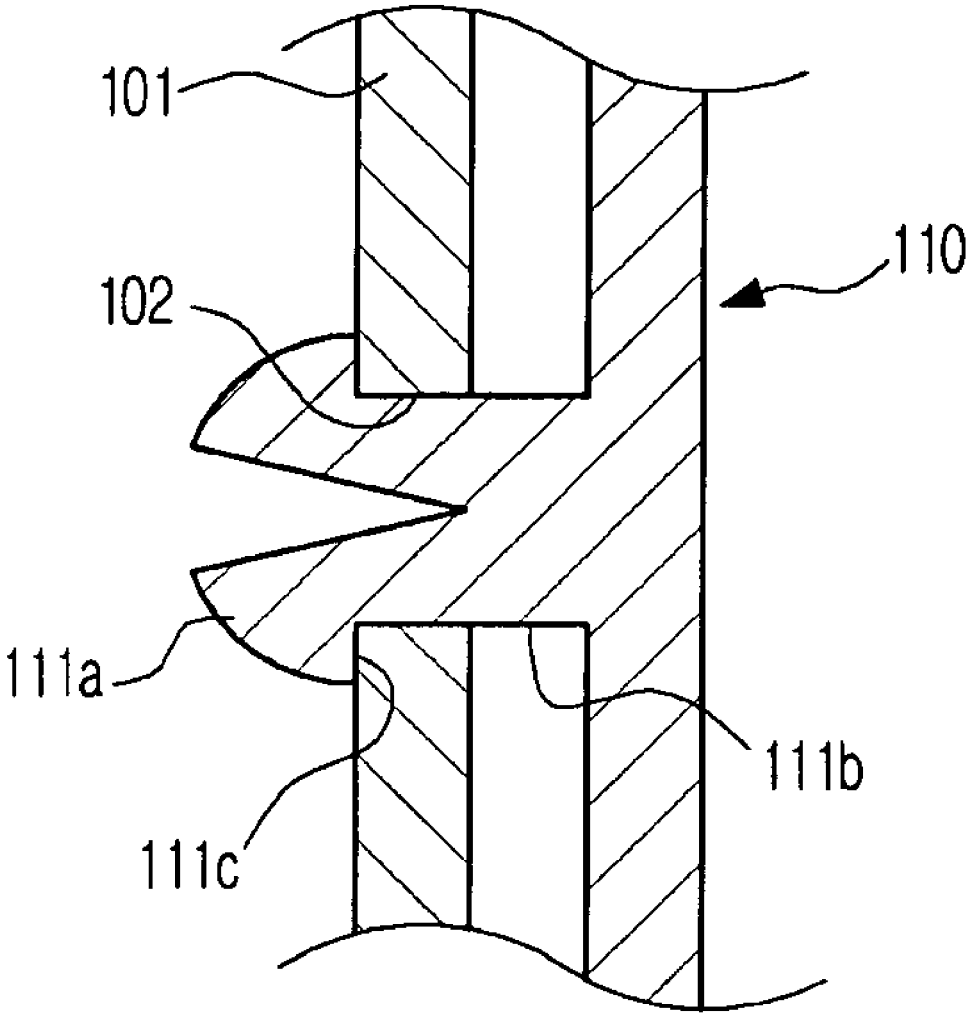
FIG. 6 is a sectional view showing parts of the assembled evaporator and cover shown in FIG. 5.

FIG. 5 is an exploded perspective view of an evaporator and a cover according to the second embodiment of the present invention, and FIG. 6 is a sectional view showing important parts of the assembled evaporator and cover shown in FIG. 5.

The same elements as those of the previously described embodiment are designated as the same reference numerals, and their description will be omitted.

In the evaporator mounting structure for the refrigerator according to the second embodiment of the present invention, as shown in FIG. 5, protruding portions 101 of fixing members 100 are bent inward, and have through-holes 102, respectively, for the coupling of a cover 110.

The cover 110 has elastic protuberances 111 to correspond to the through-holes 102. Each elastic protuberance 111, as shown in FIG. 6, includes a plurality of head portions 111*a*, a connecting portion 111*b* stepped with the plurality of head portions 111*a*, and an angled portion 111*c* between the head portions 111*a* and the connecting portion 111*b*. The plurality of head portions 111*a* are affected by elasticity to be spaced apart from one another.

With the above described configuration, if the elastic protuberance 111 is inserted into the through-hole 102, the plurality of head portions 111*a* are elastically deformed and then, are returned after being penetrated into the through-holes 102. In this case, since the plurality of head portions 111*a* are returned to be spaced apart from each other, the outer periphery of the through-hole 102 is caught by the angled portion 111*c* to enable firm coupling of the cover 110 and the evaporator.

Although the above described evaporator mounting structure can be employed to mount the evaporator to either storage compartment of the independent cooling type refrigerator according to the embodiments of the present invention, it will be appreciated that it is applicable to other various types of refrigerators.

As apparent from the above description, according to the embodiments of the present invention, an evaporator and a cover can be coupled with each other in a relatively simplified manner, for example, by engagement of first and second fixing portions provided at the evaporator and the cover, respectively, without using fasteners. The evaporator mounting structure has the effects of improving manufacturing efficiency of a refrigerator and achieving firm mounting of the evaporator.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body including an inner shell defining a storage compartment and an outer shell defining an external appearance of the refrigerator;

an evaporator having a refrigerant pipe and a fin to generate cold air;

a cold air duct having a suction flow path through which cold air of the storage compartment is suctioned and a discharge path through which cold air heat-exchanged in the evaporator is discharged into the storage compartment;

a blower to forcibly circulate the cold air of the cold air duct;

a thermal insulating member provided between the evaporator and the cold air duct;

a cover coupled with the evaporator such that the evaporator is seated on the inner shell, the cover having a water sump to collect water generated during defrosting of the evaporator; and a pair of fixing members provided at opposite sides of the evaporator so as to couple the cover and the evaporator with each other, wherein the cover is provided with an insertion hole and the pair of fixing members is provided with a protruding portion, the protruding portion being bent after being inserted through the insertion hole so as to couple the cover and the evaporator with each other.

2. The refrigerator according to claim 1, wherein the water sump is integrally formed with the cover.

3. The refrigerator according to claim 1, further comprising a barrier plate provided between the thermal insulating member and the evaporator to prevent the water generated during defrosting from permeating into the thermal insulating member and guide the water to the water sump.

* * * * *